US005806728A

United States Patent [19]

Forsström et al.

[11] Patent Number: 5,806,728

[45] Date of Patent: Sep. 15, 1998

[54] CLOTHES HANGER

[75] Inventors: Leif Forsström, Fristad; Björn Bergentoft, Löddeköpinge, both of Sweden

[73] Assignee: S. Berendsen AB, Malmo, Sweden

[21] Appl. No.: 727,564

[22] PCT Filed: Apr. 25, 1995

[86] PCT No.: PCT/SE95/00458

§ 371 Date: Dec. 5, 1996

§ 102(e) Date: Dec. 5, 1996

[87] PCT Pub. No.: WO95/28864

PCT Pub. Date: Nov. 2, 1995

[30] Foreign Application Priority Data

Apr. 25, 1994 [SE] Sweden ..... 9401393

[51] Int. Cl.[6] ..... A47G 25/48; A47G 25/14

[52] U.S. Cl. ..... 223/91; 223/96; 223/93; 223/85

[58] Field of Search ..... 223/85, 88, 92, 223/93, 91, 96

[56] References Cited

U.S. PATENT DOCUMENTS

| | | | |
|---|---|---|---|
| 759,772 | 5/1904 | Terletzky . | |
| 1,598,929 | 9/1926 | Parameter | 223/93 |
| 2,899,117 | 8/1959 | Glowka . | |
| 2,963,207 | 12/1960 | Glowka | 223/91 |
| 3,260,427 | 7/1966 | Gingher | 223/91 |
| 4,884,727 | 12/1989 | Blanchard | 223/93 |
| 4,951,484 | 8/1990 | Rohald et al. | 223/85 |
| 5,011,054 | 4/1991 | Mauffette | 223/91 |
| 5,040,707 | 8/1991 | Ayano et al. | 223/85 |

FOREIGN PATENT DOCUMENTS

| | | |
|---|---|---|
| 0 017 542 | 10/1980 | European Pat. Off. . |
| 157214 | 12/1956 | Sweden . |

*Primary Examiner*—Bibhu Mohanty
*Attorney, Agent, or Firm*—Beveridge, DeGrandi, Weilacher & Young, LLP

[57] ABSTRACT

A clothes hanger has an elongate body which is adapted to carry a garment, and a fixing member which has arms and is movable toward and away from the body between a closed position in which a garment is held between arms and the upper side of the body, and an open position in which the garment can be removed from the hanger. The fixing member is locked in its closed and open positions by cooperating snap-in fasteners provided on the fixing member and the body.

7 Claims, 2 Drawing Sheets

Figure 3:
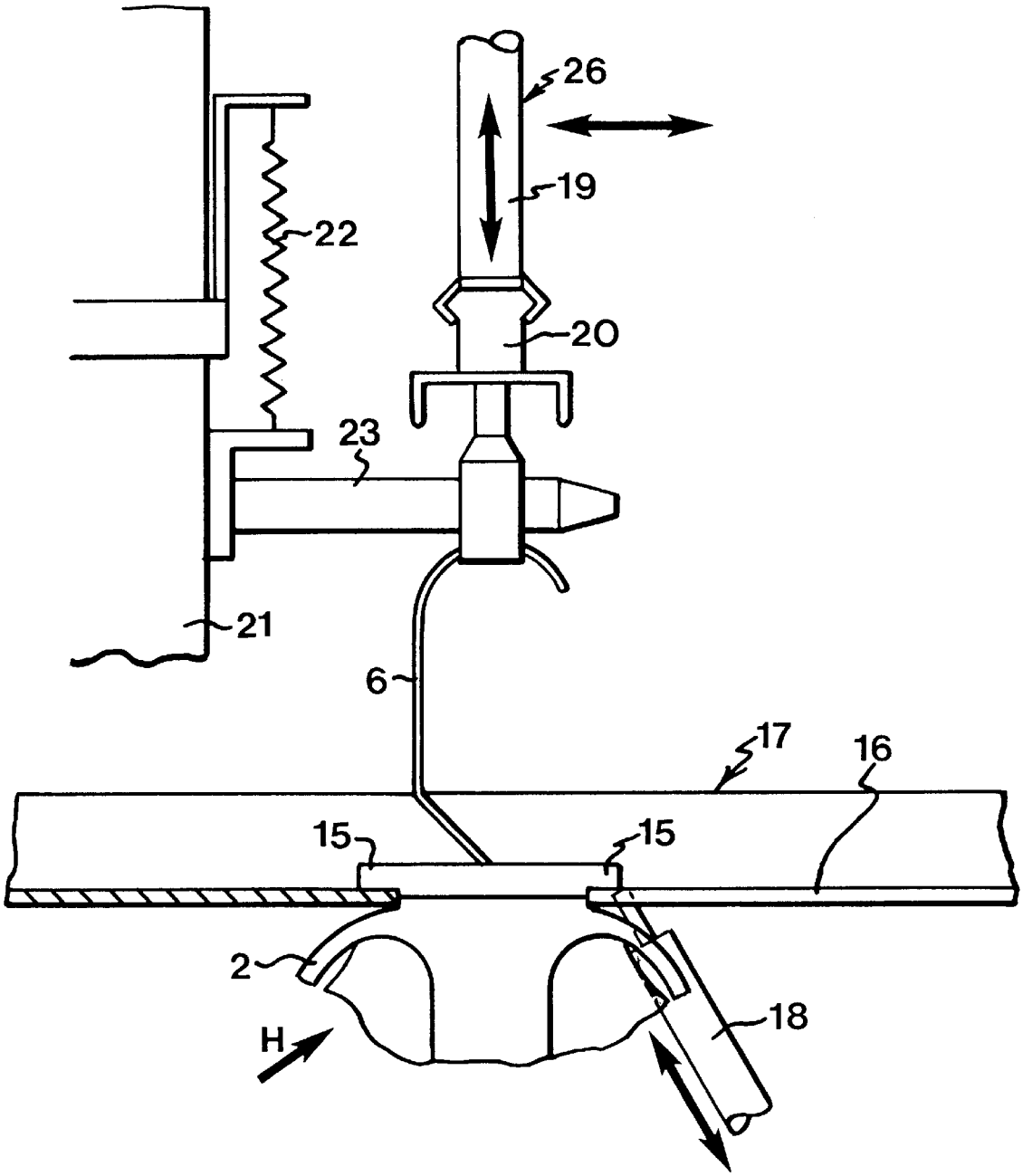

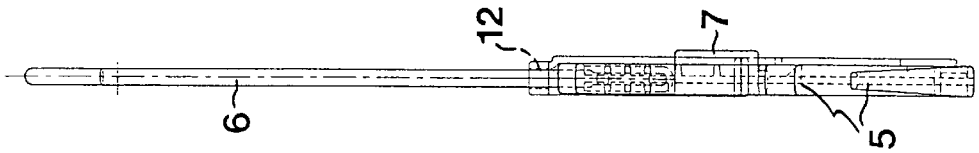
FIG.2
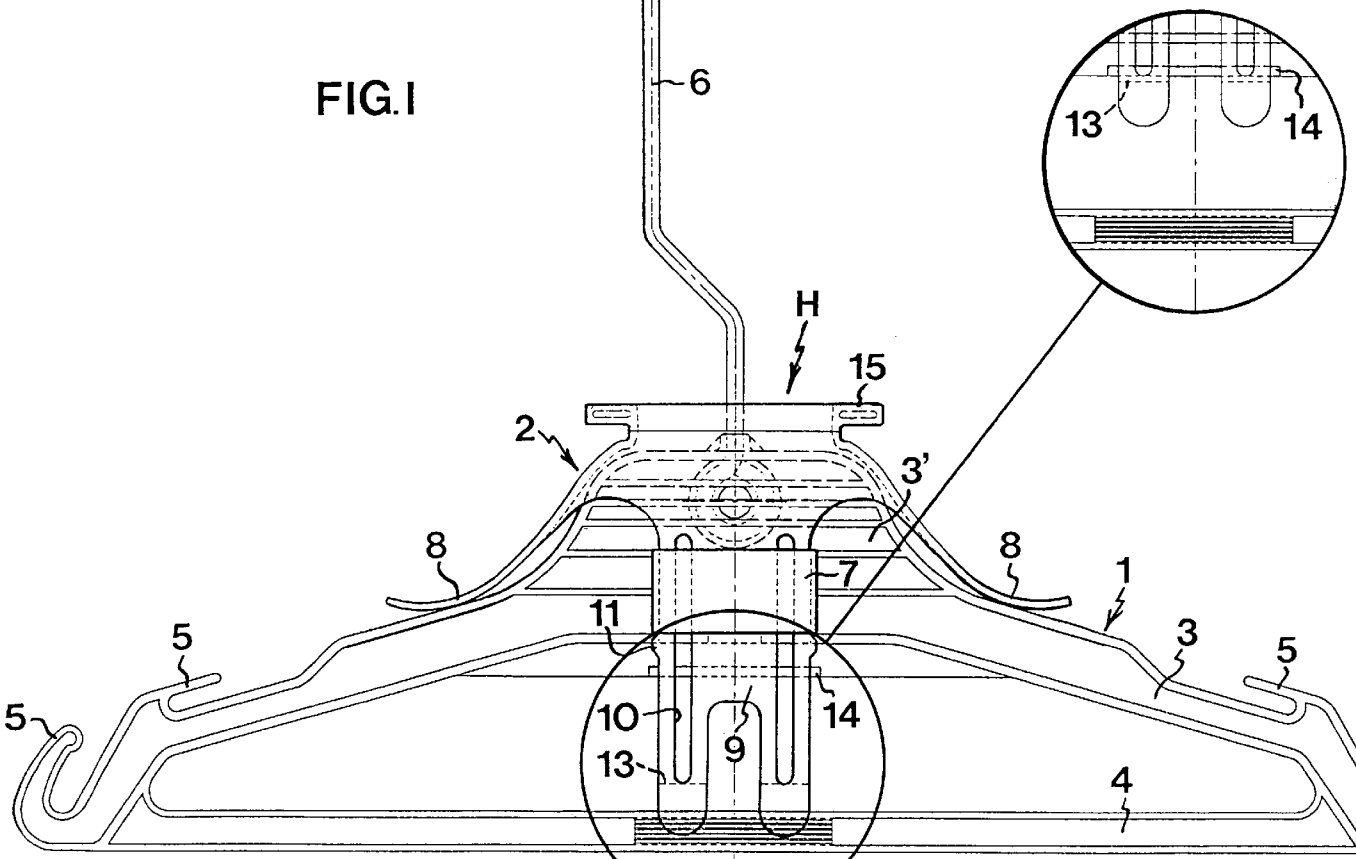
FIG.1A
FIG.1

CLOTHES HANGER

This invention relates to a clothes hanger as set forth.

There already exist clothes hangers of this type, which are intended either for domestic use, in which case the time it takes to open and close the fixing means is not of any decisive importance (see, for instance, U.S. Pat. No. 3,237,820) or for public use, in which case they are meant to prevent stealing of the suspended garment (see, for instance, EP-A-17,542) and a key is needed to open a lock holding the hanger body and the fixing means together. Furthermore, U.S. Pat. No. 2,899,117 teaches an additional device for holding a garment for the upper part of the body. This device, which is provided with short arms, can be applied to a wooden clothes hanger by hooking a projection from the device below the triangular apex of the clothes hanger, the hook shank of the hanger extending through the device. Also, SE-C-157,214 discloses a complex clothes hanger for holding a garment for the upper part of the body, which is unsuited for use in laundries owing to its many small component parts, resulting in too-rapid wear.

Laundries are large-scale consumers of clothes hangers which, disposed on conveyors, carry dirty laundry or clean laundry between various sites where the garments are treated and delivered. The garment-retaining capacity of the clothes hangers poses a problem for the laundries, especially at conveyor junctions, in that the garments may easily slip off or be thrown off. Prior-art clothes-hanger constructions have not managed to solve this problem, requiring as they do an unacceptable length of time for slipping the garments on and off the hangers or being too complex to meet the requirements for repeated re-utilisation.

The object of the invention is to provide a clothes hanger obviating the drawbacks mentioned above.

According to the invention, this object is achieved by a clothes hanger exhibiting the distinctive features recited in the characterising clause of appended claim 1.

One embodiment of the invention will now be described in more detail with reference to the accompanying drawings, in which FIG. 1 is a front view of a clothes hanger whose fixing means is in the closed position, FIG. 1A shows the fixing means when in the open position, FIG. 2 is a side view, and FIG. 3 shows a device for opening the fixing means.

The clothes hanger H comprises a basically conventional hanger member of body 1 and a garment-fixing means 2, which both are made of plastic. The conventional body 1 comprises a shoulder portion 3 for carrying a garment for the upper part of the body, a crossbar 4 for carrying e.g., trousers, hooks 5 for e.g. the braces or straps of trousers, as well as a suspension hook 6 fixedly connected to the body 1. On the one side of the top 3' of the shoulder portion 3, there is provided a pocket 7, which is open at the top and at the bottom and which is adapted to guide the fixing means 2 when moving in the vertical direction between two stable positions, namely one open and one closed position. The closed position is illustrated in FIGS. 1 and 2, and the open position is illustrated in FIG. 1A.

The fixing means 2 comprises two clamping arms 8, which are fairly short in relation to the body 1 and are adapted to clamp a garment between themselves and the upper side of the two branches of the shoulder portion 3 when the fixing means 2 occupies the closed position, as well as a shank 9, which has the guiding function indicated above and, at its lateral edges, is arranged with a narrow sliding fit in the pocket 7. The arms 8 and the shank 9 have such a thickness as to possess a certain degree of resilience. Being so short, the arms 8 do not run the risk of getting caught in automatic conveyor installations used for conveying the laundry.

The shank 9 is formed with recesses 10 enabling it to be resiliently compressed at the lateral edges. These edges are provided with cam-equipped lugs 11 which, when abutting on the lower edge of the side walls of the pocket 7, only enable opening of the fixing means 2 when a predetermined, sufficient force in the upward direction is exerted on the fixing means, in which case the lugs 11 are pushed into the pocket 7. When the fixing means 2 occupies the open position, the lugs 11 have snapped out of the pocket 7 at the top thereof. When the fixing means 2 occupies the closed position, its upper part abuts on the top 3' of the body.

As appears from FIGS. 1 and 2, the fixing means is semi-shell-shaped, such that the shank 9 is formed integral with the one side end of the arms 8, and the upper part interconnecting the arms 8 is formed with a slot 12, through which extends the hook 6.

In its open position, the fixing means 2 is retained by an abutment provided between shelf means 13 projecting rearwards (in the direction of the body 1) from the lower end portion of the shank 9, and shelf means 14 arranged on the top 3'.

In the closed position, the lower end of the shank 9 extends down to, or slightly beyond, the crossbar 4, so as to be able to retain garments, such as trousers, hanging thereon.

As points of attack for opening the fixing means 2, there are provided, at the upper part of the fixing means 2, two lateral projections 15. Preferably the fixing means 2 can be removed in its entirety from the body 1, owing to the shelf means 13 having been given such a thickness as to be able to pass through the pocket 7, which is possible if the lower part of the shank 9 is bent rearwards manually, and the fixing means 2 and the body 1 are simultaneously pressed apart. The slot 12 allows the hook 6 to pass through it, enabling a separation of the body 1 and the fixing means 2. Upper, inner and opposite lugs provided on the side walls of the pocket 7 may define an intermediate, open position.

Reference is now made to FIG. 3. The clothes hanger according to the invention is well suited for automatic handling, including opening of the garment-fixing means 2. To this end, the hanger H may, for instance by the arm of a robot, be inserted in a blind slit 16 in a rail 17, so as to engage the rail beyond the end of the slit with the one projection 15, and be locked in this position by a piston and cylinder unit 18, whose piston engages the fixing means from the opposite side. An additional piston and cylinder unit 19 arranged on the robot arm 26 can now be applied against the hook 6, enabling a release of the snap-in engagement between the lugs 11 and the lower side edges of the pocket 7. FIG. 3 also shows a loop element 20, which is releasably arranged on a garment conveyor (not shown) in order to support the clothes hanger, as well as a rod 23, which is movable on a frame 21 connected to the rail 17 against the action of a spring 22. The rod 23 engages the loop element 20 in order to lock the hook 6.

What is claimed is:

1. A clothes hanger of plastic intended for use in laundries and similar establishments where clothes are handled, comprising an elongate body (1) adapted to carry a garment for the upper part of the body, a crossbar (4) connected to said body (1) and adapted to carry a garment for the lower part of the body, and a fixing means (2), which has short arms (8) cooperating with the upper side of said body and which engages said body in such a manner as to be movable towards and away from said body in the transverse direction thereof between a closed position, in which the arms (8) and the upper side of said body hold the garment between them, and an open position, in which the garment can be removed from the hanger, the arms (8) of the fixing means (2) being resilient, so as to exert a clamping pressure on the garment in the closed position, characterized in that the fixing means (2) is, in its entirety, translationally movable in relation to the body (1), the fixing means (2) is, in its closed position, locked by cooperating snap-in fasteners (11,7), said snap-in fasteners including elements provided on the fixing means and the body which are engageable to resist movement of the fixing means relative to the body and are disengageable to permit movement of the fixing means relative to the body, the fixing means has an elongate shank (9) which is resilient in its transverse direction and which, with a view to achieving said mobility, is arranged with sliding fit in an open pocket of said body, the shank (9) and the pocket (7) being provided with said snap-in fasteners, said snap-in fasteners being biased to snapped-in engagement by the transverse resilience of said shank, the shank (9) extends, when the fixing means (2) occupies its closed position, to or beyond the crossbar (4), and the open position of the fixing means (2) is defined by abutments (13,14) provided on the body (1) and the fixing means (2).

2. A clothes hanger as set forth in claim 1, characterised in that the fixing means (2) is formed with an opening (12), through which extends the suspension hook (6) of said body (1).

3. A clothes hanger as set forth in claim 2, characterised in that the opening (12) is so designed that the fixing means (2) can be released from said body.

4. A clothes hanger as set forth in claim 1, characterised in that there are provided means (15) arranged to be engaged by tools for undoing the snap-in locking.

5. A clothes hanger as set forth in claim 2, characterised in that there are provided means (15) arranged to be engaged by tools for undoing the snap-in locking.

6. A clothes hanger as set forth in claim 3, characterised in that there are provided means (15) arranged to be engaged by tools for undoing the snap-in locking.

7. A clothes hanger as set forth in claim 1 wherein said body is an integral one-piece member which includes said hook, said body having a side surface, said pocket being located on said side surface, said fixing means having an opening through which said hook extends, said fixing means being separable from said body.

* * * * *